US011264163B2

(12) United States Patent
Horiuchi

(10) Patent No.: US 11,264,163 B2
(45) Date of Patent: Mar. 1, 2022

(54) METHOD OF MANUFACTURING WINDING-TYPE COIL COMPONENT

(71) Applicant: Murata Manufacturing Co., Ltd., Nagaokakyo (JP)

(72) Inventor: Koji Horiuchi, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 727 days.

(21) Appl. No.: 16/207,371

(22) Filed: Dec. 3, 2018

(65) Prior Publication Data

US 2019/0103214 A1 Apr. 4, 2019

Related U.S. Application Data

(63) Continuation of application No. 15/428,640, filed on Feb. 9, 2017, which is a continuation of application No. PCT/JP2015/072076, filed on Aug. 4, 2015.

(30) Foreign Application Priority Data

Aug. 19, 2014 (JP) ..... 2014-166396

(51) Int. Cl.

| | |
|---|---|
| ***H01F 27/28*** | (2006.01) |
| ***H01F 27/29*** | (2006.01) |
| ***H01F 41/10*** | (2006.01) |
| ***H01F 41/04*** | (2006.01) |
| ***H01F 27/24*** | (2006.01) |
| ***H01F 41/06*** | (2016.01) |

(52) U.S. Cl.

CPC ..... *H01F 27/2823* (2013.01); *H01F 27/24* (2013.01); *H01F 27/2828* (2013.01); *H01F 27/29* (2013.01); *H01F 41/04* (2013.01); *H01F 41/06* (2013.01); *H01F 41/10* (2013.01)

(58) Field of Classification Search

CPC .. H01F 27/24; H01F 27/2823; H01F 27/2828; H01F 27/29; H01F 41/04; H01F 41/06; H01F 41/10

See application file for complete search history.

(56) References Cited

FOREIGN PATENT DOCUMENTS

| | | | |
|---|---|---|---|
| JP | 10-135048 A | | 5/1998 |
| JP | 4001895 B | * | 3/2007 |
| JP | 4636014 B | * | 7/2008 |

OTHER PUBLICATIONS

Official Communication issued in Chinese Patent Application No. 201710940882.3, dated Nov. 2, 2018.
Horiuchi, "Method of Manufacturing Winding-Type Coil Component", U.S. Appl. No. 15/428,640, filed Feb. 9, 2017.
Horiuchi, "Method of Manufacturing Winding-Type Coil Component", U.S. Appl. No. 15/497,521, filed Apr. 26, 2017.
Horiuchi, "Method of Manufacturing Winding-Type Coil Component", U.S. Appl. No. 15/619,664, filed Jun. 12, 2017.

* cited by examiner

*Primary Examiner* — Carl J Arbes
(74) *Attorney, Agent, or Firm* — Keating & Bennett, LLP

(57) ABSTRACT

A method of manufacturing a winding-type coil component, wherein at the time of manufacturing the winding-type coil component, the method can efficiently form an inclined external electrode, can change inclination of an external electrode, and can satisfy a demand for the manufacture of plural kinds of winding-type coil components provided with external electrodes having different inclination angles respectively.

1 Claim, 10 Drawing Sheets

METHOD OF MANUFACTURING WINDING-TYPE COIL COMPONENT

CROSS REFERENCE TO RELATED APPLICATIONS

This application claims the benefit of priority to Japanese Patent Application 2014-166396 filed on Aug. 19, 2014, and to International Patent Application No. PCT/JP2015/072076 filed Aug. 4, 2015, the entire content of which are incorporated herein by reference.

TECHNICAL FIELD

The present disclosure relates to a method of manufacturing a coil component, and more particularly to a method of manufacturing a winding-type coil component which has a structure where a pair of flange portions is formed on both end sides of a winding core portion on which a winding is wound, and external electrodes which are inclined such that heights of the external electrodes are gradually increased from first surfaces of the respective flange portions which opposedly face each other to second surfaces of the respective flange portions on sides opposite to the first surfaces are formed on the pair of flange portions.

BACKGROUND

Japanese Patent Application Laid-Open No. H9-219333 A proposes a method of manufacturing a winding-type coil component shown in FIG. 12, for example.

A winding-type coil component 100 shown in FIG. 12 whose manufacturing method is proposed in Japanese Patent Application Laid-Open No. H9-219333 A includes: a core member 101 having a columnar winding core portion 102 and a pair of flange portions 103 (a first-side flange portion 103*a*, a second-side flange portion 103*b*) which is formed on both ends of the winding core portion 102; a pair of external electrodes 104*a*, 104*b* formed on the pair of flange portions 103 (the first-side flange portion 103*a*, the second-side flange portion 103*b*); and a winding 105 wound on the winding core portion. In such a configuration, the external electrodes 104*a*, 104*b* are formed in regions of the first-side flange portion 103*a* and the second-side flange portion 103*b* near an object (for example, a printed circuit board or the like) on which the winding-type coil component 100 is mounted.

Further, the external electrodes 104*a*, 104*b* are formed as follows so as to prevent the occurrence of drawbacks such as lowering of a characteristic such as a magnetic field and rounding around of solder to the coil (winding 105). The electrodes are not formed on a surface (opposedly-facing surface) of the first-side flange portion 103*a* and a surface (opposedly-facing surface) of the second-side flange portion 103*b* which opposedly face each other, and the external electrodes 104*a*, 104*b* are formed such that heights of the external electrodes 104*a*, 104*b* are increased from the above-mentioned opposedly-facing surface sides toward opposite surface sides of the first-side flange portion 103*a* and the second-side flange portion 103*b*.

Japanese Patent Application Laid-Open No. H9-219333 A also describes that, in the manufacture of the winding-type coil component shown in FIG. 12, a method of forming an inclined external electrode as a method of forming the above-mentioned external electrodes (hereinafter also referred to as "inclined external electrodes"). The method includes the steps of: applying by coating a conductive paste to a pair of flange portions 103 (a first-side flange portion 103*a*, a second-side flange portion 103*b*) by immersing a core member (ferrite core) 101 in a bath 109 in which a conductive paste 108 for forming the external electrodes is pooled as shown in FIG. 13; and baking the conductive paste.

However, in the case of the above-mentioned method described in Japanese Patent Application Laid-Open No. H9-219333 A, even when a user wants to change an inclination angle of the external electrode (inclined external electrode) 104*a*, 104*b*, changing of the inclination angles is not easy. That is, such changing of the inclination angle requires facilities and installations dedicated to such a purpose thus giving rise to a drawback that a cost is pressed up.

SUMMARY

Problem to be Solved by the Disclosure

The present disclosure has been made to solve the above-mentioned problem, and it is an object of the present disclosure to provide a method of manufacturing a winding-type coil component, wherein at the time of manufacturing the winding-type coil component provided with external electrodes which are inclined such that heights of the external electrodes are gradually increased from first surfaces which opposedly face each other to second surfaces disposed opposite to the first surfaces of the first-side flange portion and the second-side flange portion which form a core member (inclined external electrodes), inclination of the external electrode can be changed so that the method can satisfy a demand for the manufacture of plural kinds of winding-type coil components provided with external electrodes having different inclination angles respectively.

Means for Solving the Problem

To solve the above-mentioned problem, a method of manufacturing a winding-type coil component according to the present disclosure is a method of manufacturing a winding-type coil component having a structure where the coil component includes: a core member having a columnar winding core portion and a pair of flange portions formed on both ends of the winding core portion; a pair of external electrodes provided on a first-side flange portion and a second-side flange portion which form the pair of flange portions respectively; and a winding wound on the winding core portion, and the pair of respective external electrodes is inclined such that heights of the pair of external electrodes are respectively gradually increased from first surfaces of the pair of flange portions which opposedly face each other to second surfaces of the pair of flange portions on sides opposite to the first surfaces, wherein the method includes:

a core member adhering and holding step in which a holding member having adhesiveness and elasticity is prepared, the holding member being capable of detachably holding the core member on a main surface thereof and having an inclined surface which makes a predetermined angle with respect to the main surface thereof on a portion of the main surface, and the core member is adhered to and held on the inclined surface of the holding member in such a manner that the core member assumes a posture that an axis of the winding core portion of the core member has an inclination of a predetermined angle with respect to the main surface of the holding member, and a region of the core member where the external electrode on the first-side flange portion of the core member is to be formed protrudes more from the main surface of the holding member than the second-side flange portion; and an electrode paste coating pattern forming step in which the region of the core member held on the holding member where the external electrode on the first-side flange portion of the core member is to be formed is brought into contact with a surface of a surface plate on the surface of which an electrode paste layer is formed, the holding member is further pressed toward the surface plate so as to change a posture of the core member such that the inclination of the axis of the winding core portion of the core member with respect to the surface of the surface plate changes whereby an electrode paste coating pattern is formed on the region where the external electrode on the first-side flange portion is to be formed in a predetermined mode that the electrode paste coating pattern is inclined such that a height of the electrode paste coating pattern is gradually increased from first surfaces of the pair of flange portions which opposedly face each other to second surfaces of the pair of flange portions on sides opposite to the first surfaces.

In the method of manufacturing a winding-type coil component according to the present disclosure, the method further includes:

a core member transferring step in which the core member where the electrode paste coating pattern is formed on the first-side flange portion is transferred to a transfer sheet which is provided for transferring the core member and exhibits adhesiveness larger than adhesiveness of the holding member at the time of transferring the core member and whose adhesiveness can be lost or can be set lower than adhesiveness of the holding member after the core member is transferred;

a step in which the adhesiveness of the transfer sheet is lost or is set lower than the adhesiveness of the holding member;

a core member adhering and holding step in which the core member is adhered to and held on the other inclined surface which differs from the inclined surface of the holding member from the transfer sheet whose adhesiveness is lost or is set lower than adhesiveness of the holding member in such a manner that the core member assumes a posture that the axis of the winding core portion of the core member has an inclination of a predetermined angle with respect to the main surface of the holding member, and a region of the core member where the external electrode on the second-side flange portion of the core member is to be formed protrudes more from the main surface of the holding member than the first-side flange portion; and an electrode paste coating pattern forming step in which the region of the core member held on the holding member where the external electrode on the second-side flange portion of the core member is to be formed is brought into contact with the surface of the surface plate on the surface of which an electrode paste layer is formed, the holding member is further pressed toward the surface plate so as to change a posture of the core member such that the inclination of the axis of the winding core portion of the core member with respect to the surface of the surface plate changes whereby an electrode paste coating pattern is formed on the region where the external electrode on the second-side flange portion is to be formed in a predetermined mode that the electrode paste coating pattern is inclined such that a height of the electrode paste coating pattern is gradually increased from the first surface sides of the pair of flange portions which opposedly face each other to the second surface sides of the pair of flange portions on sides opposite to the first surface sides.

With the above-mentioned configuration, the formation of the first-side external electrode on the first-side flange portion of the core member and the formation of the second-side external electrode on the second-side flange portion of the core member which form the winding-type coil component can be performed efficiently. At the same time, modes of inclinations of the first-side external electrode and the second-side external electrode can be acquired as intended and hence, it is possible to efficiently manufacture a highly reliable winding-type coil component provided with the inclined external electrodes having high shape accuracy.

It is preferable that one of a sheet whose adhesiveness is lost by irradiating ultraviolet rays to the sheet (hereinafter also abbreviated to as "UV sheet") and a sheet whose adhesiveness is lost by heating the sheet (hereinafter also abbreviated to as "heat peel off sheet") be used as the transfer sheet.

By using one of the above-mentioned "UV sheet" and "heat peel off sheet" described above as the transfer sheet, the transfer of the core member from the holding member to the transfer sheet and the transfer of the core member from the transfer sheet to the holding member performed thereafter can be performed easily with certainty and hence, the present disclosure can be practically used.

It is preferable that the inclined surface and the other inclined surface be formed of a pair of surfaces which forms a groove disposed on the main surface of the holding member.

The inclined surface and the other inclined surface given above are formed of the pair of surfaces which forms the groove disposed on the main surface of the holding member and hence, the number of core members which can be held per unit area of the holding member can be increased. Accordingly, a large number of core members can be efficiently handled thus enhancing productivity of the core members.

Advantageous Effect of the Disclosure

In the method of manufacturing a winding-type coil component of the present disclosure, the core member is adhered to and held on the inclined surface formed on the main surface of the holding member having adhesiveness and elasticity in such a manner that the core member assumes a posture that the axis of the winding core portion of the core member has the inclination of a predetermined angle with respect to the main surface of the holding member, and the region of the core member where the external electrode provided on the first-side flange portion of the core member is to be formed protrudes more from the main surface of the holding member than the second-side flange portion. Thereafter, the region (protruding region) of the core member where the external electrode provided on the first-side flange portion of the core member is to be formed is brought into contact with the surface of the surface plate on the surface of which the electrode paste layer is formed. Further, the holding member is pressed toward the surface plate so as to change the posture of the core member such that the inclination of the axis of the winding core portion of the core member changes. Accordingly, an electrode paste coating pattern can be efficiently formed on the region where the external electrode provided on the first-side flange portion is to be formed in an intended mode that the electrode paste coating pattern is inclined such that a height of the electrode paste coating pattern is gradually increased from the first surfaces of the pair of flange portions which opposedly face each other to the second surfaces of the pair of flange portions on sides opposite to the first surfaces. As a result, it is possible to manufacture a highly reliable winding-type coil component provided with the inclined external electrodes having high shape accuracy with certainty.

Further, according to the method of manufacturing a winding-type coil component of the present disclosure, the inclination of the external electrode can be changed and hence, the method can satisfy a demand for the manufacture of plural kinds of winding-type coil components provided with external electrodes having different inclination angles respectively.

In the present disclosure, the main surface of the holding member means a main planar surface as viewed with respect to the whole surface which holds the core member excluding portions where the inclined surface is disposed, projecting portion and the like.

DETAILED DESCRIPTION

Hereinafter, the technical features of the present disclosure are described in further detail in conjunction with embodiments of the present disclosure.

Embodiment 1

Figure 1A:
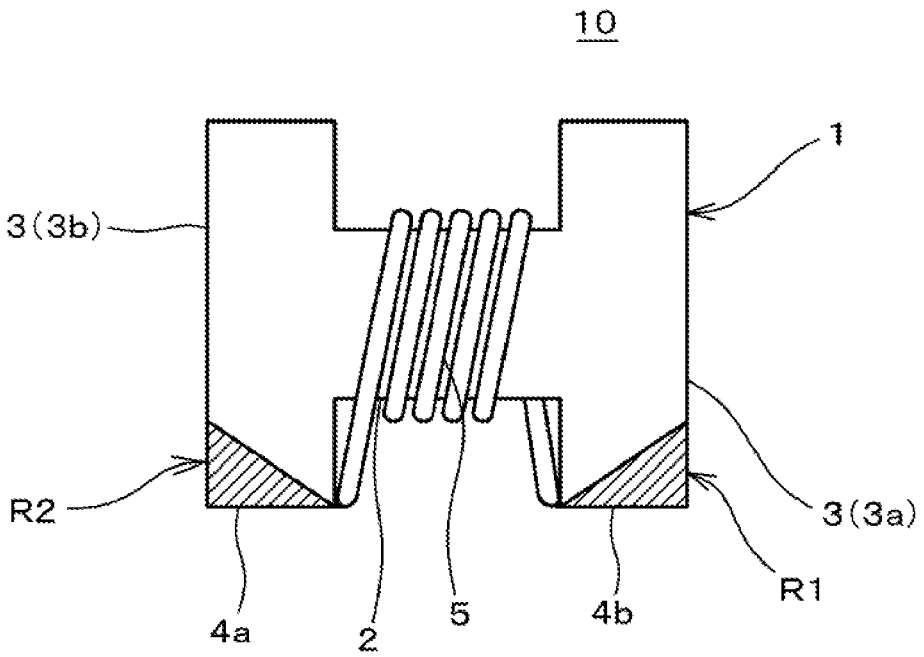
FIG. 1(*a*) and FIG. 1(*b*) are views showing one example of a winding-type coil component manufactured by a method of the present disclosure, wherein FIG. 1(*a*) is a front view, and FIG. 1(*b*) is a side view.
Figure 1B:
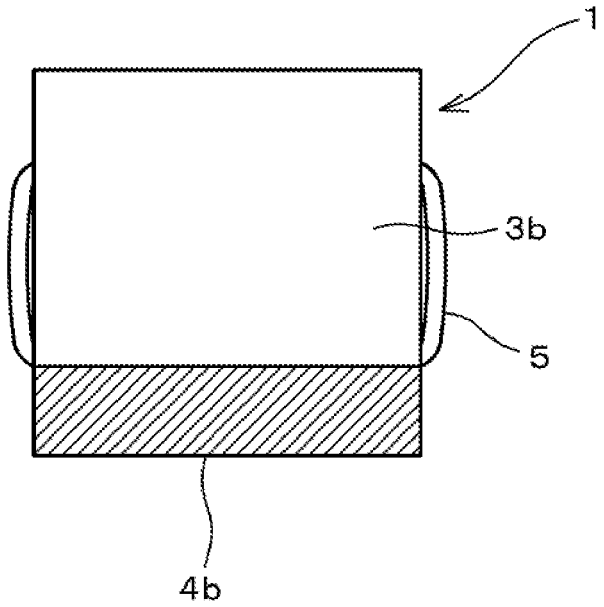

In Embodiment 1, a method of manufacturing a winding-type coil component (winding type inductor) having a structure shown in FIG. 1(*a*) and FIG. 1(*b*) is described by mainly focusing on steps for forming external electrodes on a core member.

A winding-type coil component 10 manufactured in Embodiment 1 includes: a core member 1 having a winding core portion 2 and a pair of flange portions (a first-side flange portion 3*a* and a second-side flange portion 3*b*) which is connected to both ends of the winding core portion 2; a pair of external electrodes (external electrodes 4*a*, 4*b*) disposed on the first-side flange portion 3*a* and the second-side flange portion 3*b* of the core member 1; and a winding 5 wound on the winding core portion 2. Both ends of the winding 5 are connected to the external electrodes 4*a*, 4*b* respectively by soldering or the like.

The external electrodes 4*a*, 4*b* are formed as follows so as to prevent the occurrence of drawbacks such as lowering of a characteristic such as a magnetic field and rounding around of solder to a coil (winding 5). The external electrodes 4*a*, 4*b* are not formed on first surfaces (opposedly-facing surfaces) of the first-side flange portion 3*a* and the second-side flange portion 3*b* which opposedly face each other, while the external electrodes 4*a*, 4*b* are formed such that the heights of the formed external electrodes 4*a*, 4*b* are increased from the opposedly-facing surface sides toward second surface sides of the first-side flange portion 3*a* and the second-side flange portion 3*b* opposite to the opposedly-facing surfaces. That is, the external electrodes 4*a*, 4*b* are formed in a mode where upper sides of the external electrodes on side surfaces of the first-side flange portion 3*a* and the second-side flange portion 3*b* are inclined. In this embodiment, a case is exemplified where the electrode is not formed on an inner wall surface of the flange portion. However, the electrode structure is not limited to the above-mentioned structure. The electrodes may also be formed on the inner wall surfaces of the flange portions provided that heights of the external electrodes 4*a*, 4*b* formed on the inner wall surfaces are lower than heights of the external electrodes 4*a*, 4*b* formed on outer wall surfaces of the flange portions.

Further, a ceramic-based material (alumina, ferrite or the like, for example), a metal magnetic material or the like may be used as a material for forming the core member 1.

Silver, copper or the like may be used as a material for forming the external electrode 4*a*, 4*b*.

The present disclosure is also applicable to a case of manufacturing a winding-type coil component where the winding 5 is protected by a protection member made of a material which contains a thermosetting resin such as an epoxy resin as a main component.

Next, a method of manufacturing the winding-type coil component 10 is described.

First, a core member 1 shown in FIG. 1(*a*) and FIG. 1(*b*) is prepared. The core member 1 includes: the winding core portion 2; and the pair of flange portions (the first-side flange portion 3*a* and the second-side flange portion 3*b*) which is connected to both ends of the winding core portion 2.

Next, the external electrodes 4*a*, 4*b* are formed in accordance with steps described hereinafter.

Figure 2:
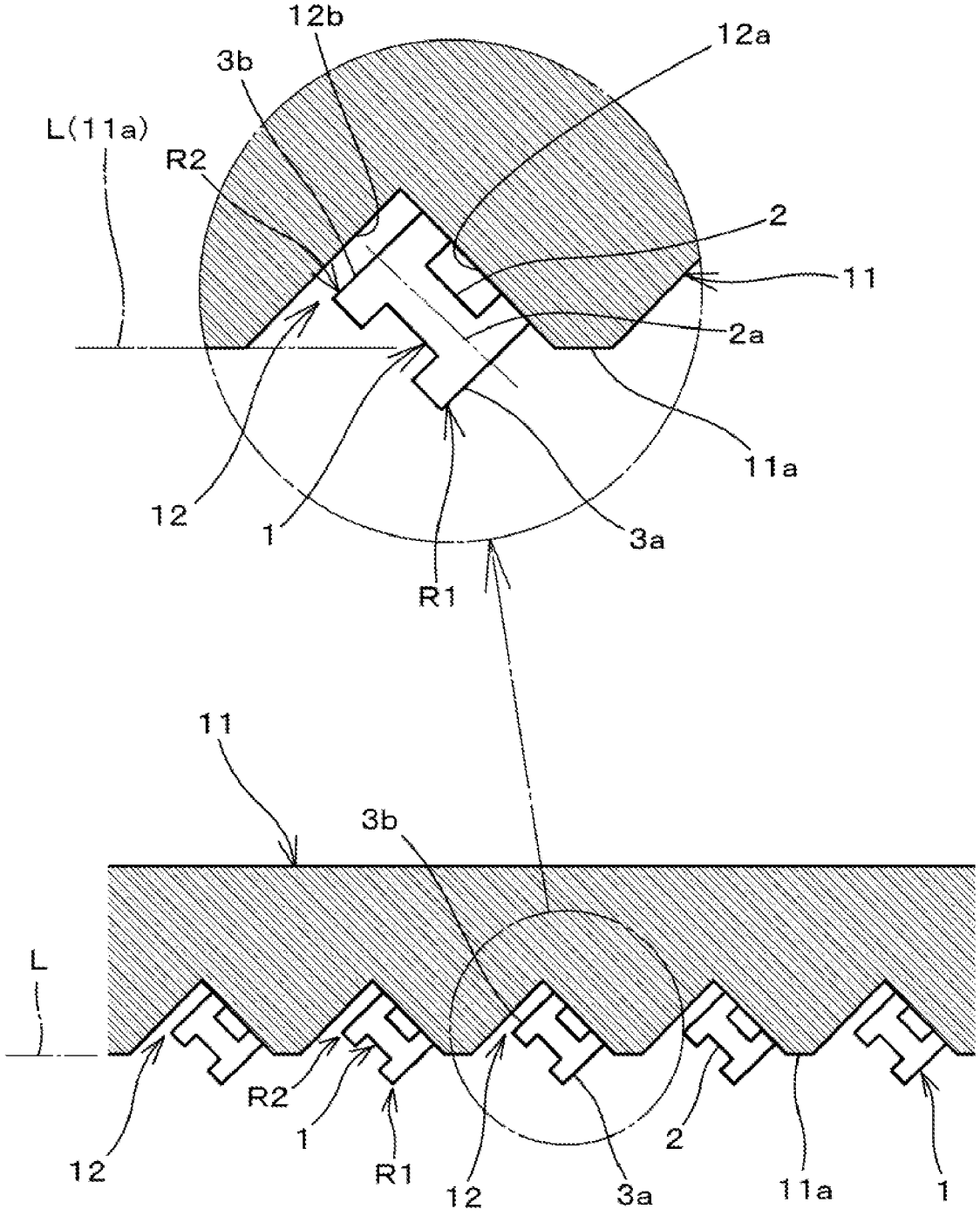
FIG. 2 is a view for describing a method of manufacturing a winding-type coil component according to Embodiment 1 of the present disclosure, and is also a view showing a state where core members are held on a holding member.

(a) First, as shown in FIG. 2, the core members 1 are held on the holding member 11 having adhesiveness and elasticity in such a manner that the core members 1 are detachably holding the core members held on a main surface 11*a* of the holding member 11.

In Embodiment 1, as a holding member, the holding member 11 made of silicone rubber or the like, for example, and having adhesiveness and elasticity is used. The holding member 11 has a plurality of V-shaped grooves 12 each of which is formed of an inclined surface (first-side inclined surface) 12*a* having a predetermined angle θ with respect to the main surface 11*a* and another inclined surface (second-side inclined surface) 12*b* thereon.

The main surface 11*a* of the holding member 11 is a surface formed of regions of the holding member 11 except for regions where the V-shaped grooves 12 each having the first-side inclined surface 12*a* and the second-side inclined surface 12*b* are formed. In Embodiment 1, the main surface 11*a* of the holding member 11 means a surface indicated by a line L in FIG. 2.

To make the holding member 11 hold the core members 1, each core member 1 is held on the holding member 11 such that the first-side flange portion 3*a* and the second-side flange portion 3*b* of the core member 1 are adhered to and held on the first-side inclined surface 12*a* of the holding member, and the core member 1 assumes a posture that an axis 2*a* of the winding core portion 2 of the core member 1 has an inclination of a predetermined inclination angle with respect to the main surface 11*a* of the holding member 11, and a region R1 of the core member 1 where the external electrode 4*a* formed on the first-side flange portion 3*a* of the core member 1 (FIG. 1(*a*)) is to be formed protrudes more from the main surface 11*a* of the holding member 11 than the second-side flange portion 3*b*.

Figure 3:
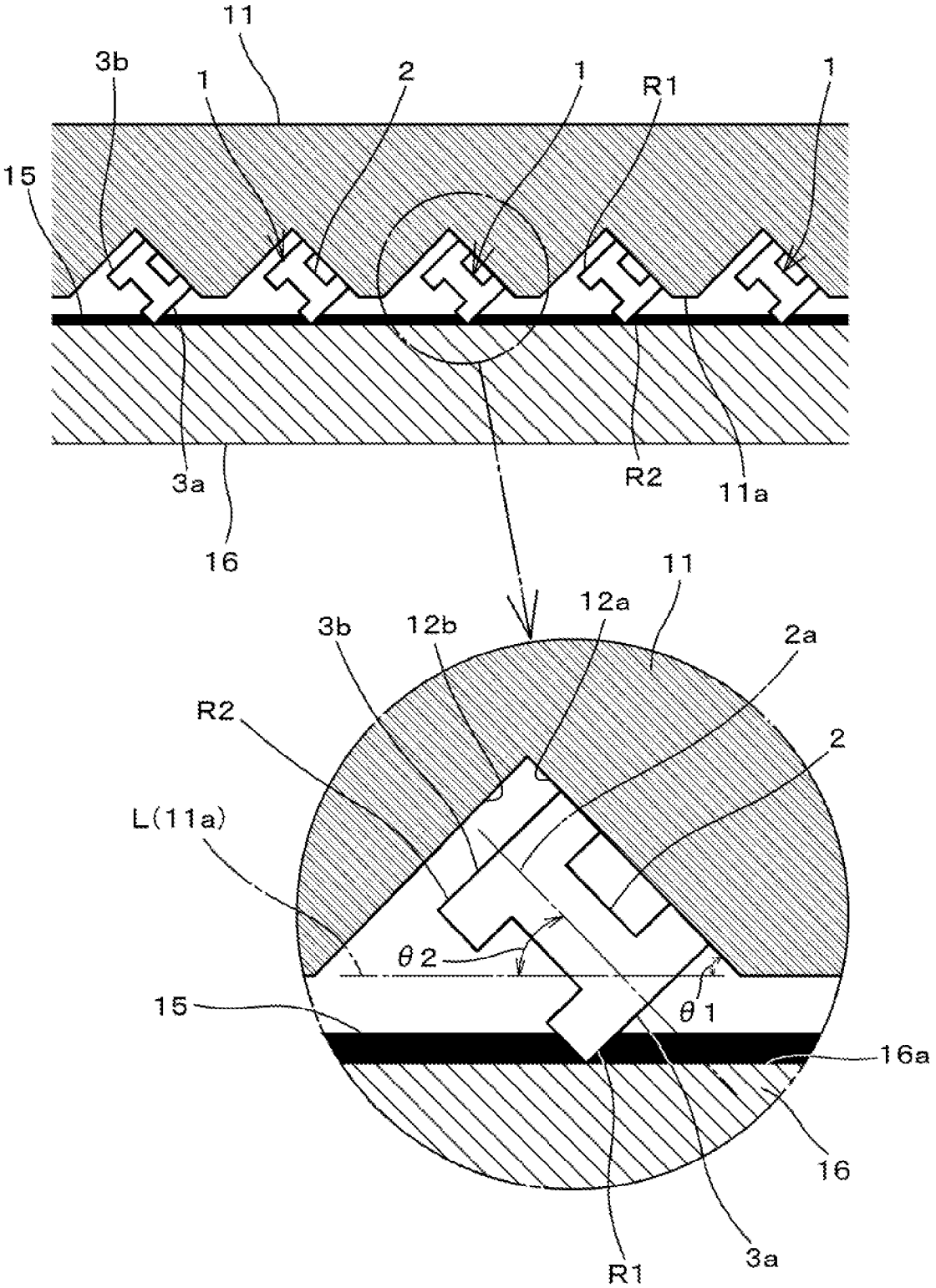
FIG. 3 is a view showing "a first stage of a coating step" where an electrode paste is applied by coating to a region of each core member where an external electrode provided on a first-side flange portion of the core member is to be formed in the method of manufacturing a winding-type coil component according to Embodiment 1 of the present disclosure.

(b) Next, as shown in FIG. 3, the holding member 11 and a surface plate 16 are made to opposedly face each other such that the main surface 11*a* of the holding member 11 and a surface 16*a* of the surface plate 16 become parallel to each other. Then, the holding member 11 is moved toward the surface plate 16, and the regions R1 of the core members 1 held on the holding member where the external electrodes 4*a* formed on the first-side flange portions 3*a* of the core members 1 (FIG. 1(*a*)) are to be formed are brought into contact with the surface plate (table) 16 on the surface 16*a* of which an electrode paste layer 15 is formed. At this stage of operation, as shown in FIG. 3, the regions R1 are brought into contact with the surface plate 16 to an extent that the holding member 11 is not deformed (a first stage of a coating step). As a result, an inclination angle θ1 of the axis 2*a* of the winding core portion 2 of the core member 1 with respect to the main surface 11*a* of the holding member 11 becomes equal to an inclination angle θ of the first-side inclined surface 12*a*. At this stage of operation, an inclination angle θ2 of the axis 2*a* with respect to the surface 16*a* of the surface plate 16 also becomes equal to the above-mentioned inclination angle θ1.

Figure 5:
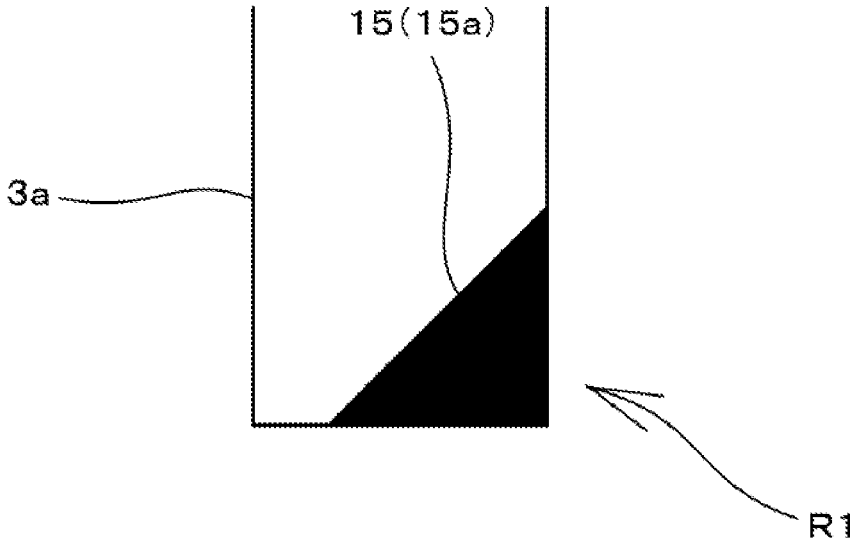
FIG. 5 is a view showing a state where the electrode paste is applied by coating to the first-side flange portion in "the first stage of the coating step".

In the first stage of the coating step, as shown in FIG. 5, a coating film (inclined coating film) 15*a* formed using the electrode paste 15 is formed such that the coating film 15*a* reaches an intermediate portion of the first-side flange portion 3*a* in the width direction from an outer wall surface side of the first-side flange portion 3*a*.

Figure 4:
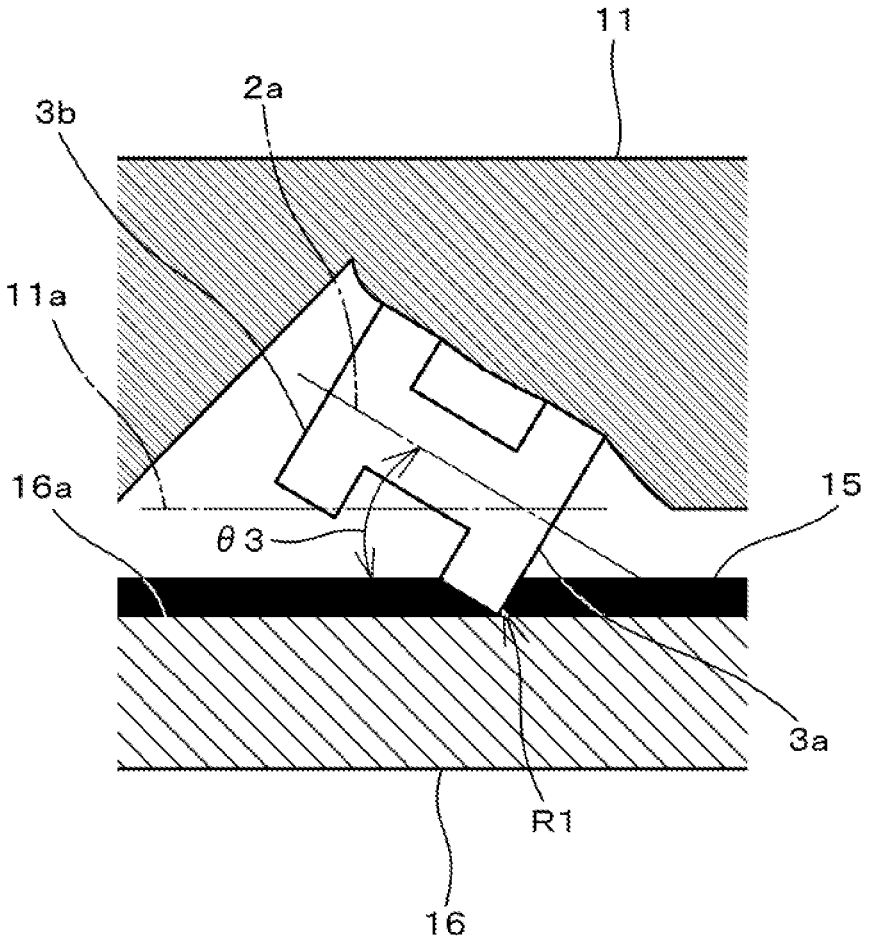
FIG. 4 is a view showing "a second stage of the coating step" where the electrode paste is applied by coating to the region of the core member where the external electrode provided on the first-side flange portion of the core member is to be formed in the method of manufacturing a winding-type coil component according to Embodiment 1 of the present disclosure.

(c) Then, as shown in FIG. 4, each holding member 11 is further pressed toward the surface plate 16 so as to change a posture of the core member 1 such that the inclination of the axis 2*a* of the winding core portion 2 of the core member 11 changes from the inclination of the axis 2*a* of the winding core portion 2 in the first stage of the coating step (at this stage of operation, the holding member 11 having elasticity is deformed so that a change in posture of the core member 1 is allowed) (a second stage of the coating step). That is, in the second stage of the coating step, the holding member 11 is deformed due to a force which presses the holding member 11 to the surface plate 16 so that an inclination angle θ3 of the axis 2*a* of the winding core portion 2 of the core member 1 with respect to the surface 16*a* of the surface plate 16 becomes smaller than the inclination angle θ2 of the axis 2*a* of the winding core portion 2 with respect to the surface 16*a* of the surface plate 16 in the above-mentioned first stage of the coating step.

Figure 6:
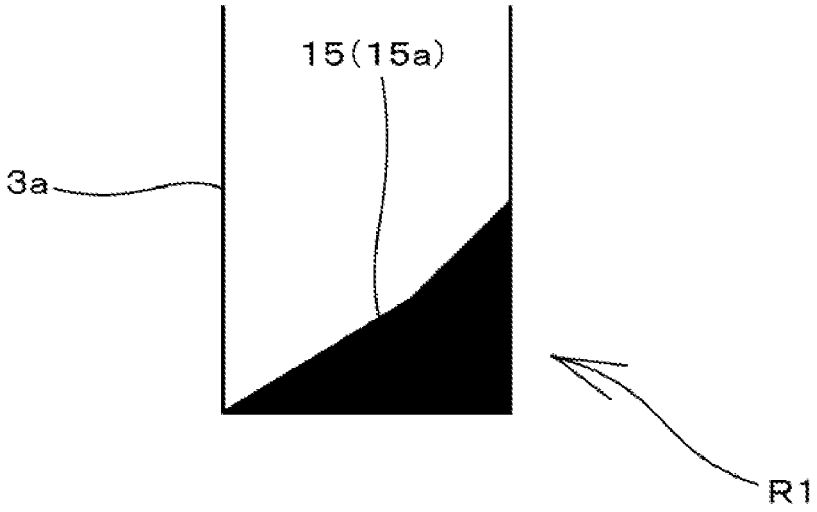
FIG. 6 is a view showing a state where the electrode paste is applied by coating to the first-side flange portion in "the second stage of the coating step".

As a result, although the coating film 15*a* formed using the electrode paste 15 is formed ranging from the outer wall surface side of the first-side flange portion 3*a* to the intermediate portion of the first-side flange portion 3*a* in the width direction in the first stage of the coating step as shown in FIG. 5, in the second stage of the coating step, as shown in FIG. 6, the coating film 15*a* formed using the electrode paste 15 is formed on the entire first-side flange portion 3*a* in the width direction ranging from the outer wall surface side to an inner wall surface side of the first-side flange portion 3*a*. The coating film (electrode paste coating pattern) 15*a* formed of the electrode paste 15 which is formed in the second stage of the coating step has a pattern (electrode paste coating pattern) which is inclined such that a height of the pattern is gradually increased from the inner wall surface side to the outer wall surface side. The coating film 15*a* becomes the external electrode 4*a* after the coating film 15*a* is baked.

In further pressing the holding member 11 toward the surface plate 16 in the second stage of the coating step so as to make the above-mentioned inclination angle θ3 of the axis 2*a* of the winding core portion 2 of the core member 11 smaller than the inclination angle θ2 of the axis 2*a* of the winding core portion 2 in the first stage of the coating step (that is, the inclination angle θ3 being set to $\theta 2-\alpha(\theta 3=\theta 2-\alpha)$), appropriate conditions are set by taking into account elasticity of the holding member 11, a shape of the core member 1, the pressing direction when the holding member 11 is pressed to the surface plate 16 and the like.

Figure 7:
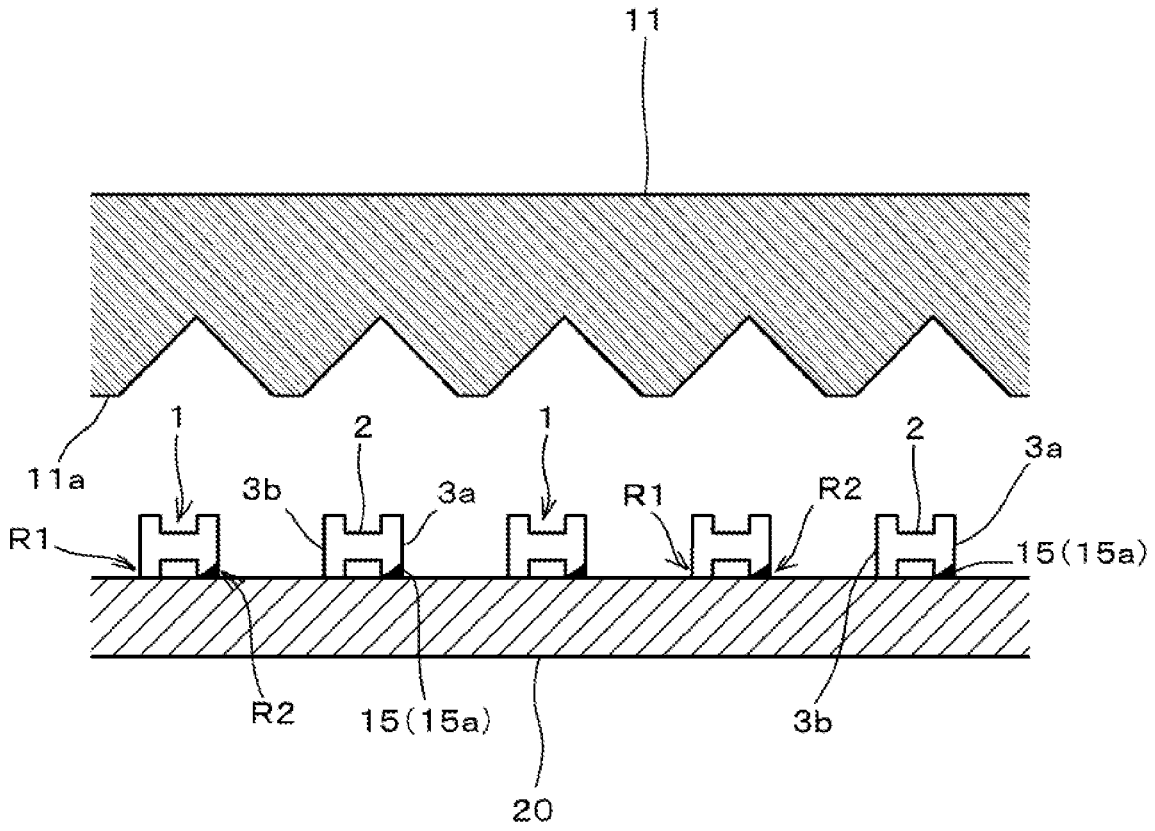
FIG. 7 is a view showing a state where the core members are transferred to a transfer sheet in one step of the method of manufacturing a winding-type coil component according to Embodiment 1 of the present disclosure.

(d) Next, as shown in FIG. 7, the core members 1 held on the holding member 11 are transferred onto a transfer sheet 20. At this stage of operation, the coating film (electrode paste coating pattern) 15*a* is formed on each of the core members 1 by applying the electrode paste 15 to the first-side flange portion 3*a*. The transfer sheet 20 is a transfer sheet which exhibits adhesiveness larger than adhesiveness of the holding member 11 at the time of transferring the core members 1 and whose adhesiveness of the transfer sheet 20 can be lost after the core members 1 are transferred to the transfer sheet 20. By pressing the core members 1 held on the holding member 11 to the transfer sheet 20, it is possible to transfer the core members 1 to the transfer sheet 20 having a larger adhesive force than the holding member 11 with certainty.

In Embodiment 1, a sheet whose adhesiveness is lost by irradiating ultraviolet rays to the sheet (UV sheet) is used as the transfer sheet 20.

Figure 8:
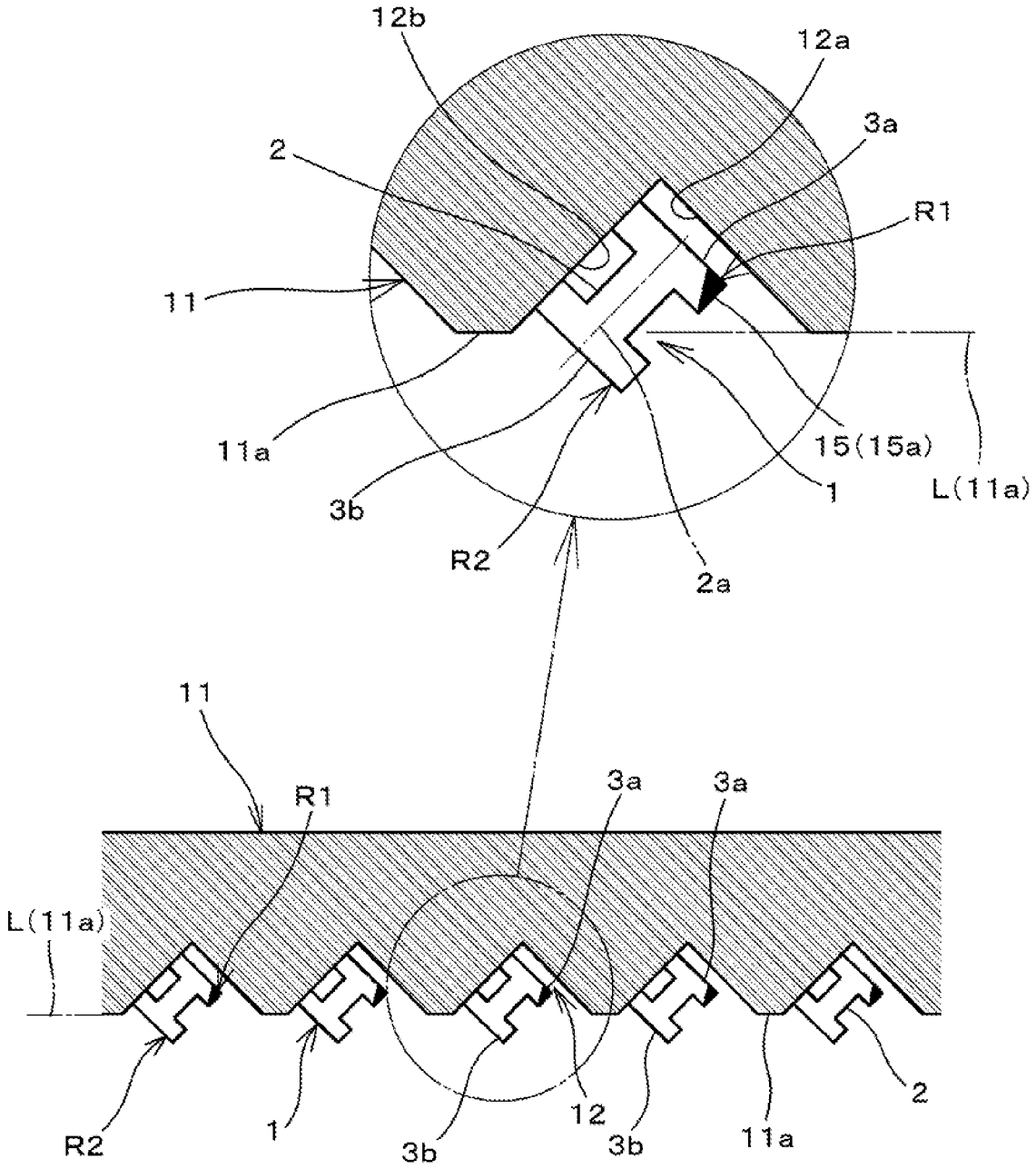
FIG. 8 is a view showing a state where the core members are held on the holding member so as to apply the electrode paste to second-side flange portions by coating in one step of the method of manufacturing a winding-type coil component according to Embodiment 1 of the present disclosure.

(e) Then, as shown in FIG. 8, the core members 1 disposed on the transfer sheet 20 whose adhesiveness is lost by irradiating ultraviolet rays to the sheet 20 are adhered to and held on the other inclined surface (second-side inclined surface) 12*b* which differs from the first-side inclined surface 12*a* of the holding member 11 in a posture where the axis 2*a* of the winding core portion 2 of each core member 1 has the inclination of a predetermined angle with respect to the main surface 11*a* of the holding member 11, and the region R2 of each core member 1 where the external electrode 4*b* formed on the second-side flange portion 3*b* of each core member 1 (FIG. 1(*a*)) is to be formed protrudes more from the main surface 11*a* of the holding member 11 than the first-side flange portion 3*a*.

(f) Next, using the same method as the method described in the above-mentioned (b) and (c), an electrode paste is applied by coating to the region R2 of each core member 1 where the external electrode 4*b* formed on the second-side flange portion 3*b* of each core member 1 (FIG. 1(*a*)) is to be formed. At this stage of operation, as described in the above-mentioned (b) and (c), the electrode paste is applied by coating to each region R2 through the first stage of the coating step and the second stage of the coating step so that a following pattern (electrode paste coating pattern) is formed. That is, the electrode paste coating pattern ranges from a first surface side (inner wall surface side) of the second-side flange portion 3*b* which opposedly faces the first-side flange portion 3*a* (FIG. 1(*a*)) to a second surface side (outer wall surface side) of second-side flange portion 3*b* opposite to the first surface side and, at the same time, the electrode paste is inclined such that a height of the electrode paste coating pattern is gradually increased from the inner wall surface side to the outer wall surface side.

Then, the core member 1 on which the electrode paste coating patterns are formed by applying the electrode paste to the region R1 where the external electrode provided on the first-side flange portion 3*a* is to be formed and the region R2 where the external electrode provided on the second-side flange portion 3*b* is to be formed is baked. By baking the electrode paste to the core member 1, it is possible to obtain the core member 1 provided with the pair of external electrodes 4*a*, 4*b* having a predetermined shape on the first-side flange portion 3*a* and the second-side flange portion 3*b* (FIG. 1(*a*), (*b*)).

Then, the winding 5 is wound on the winding core portion 2 of the core member 1, and both ends of the winding 5 are connected to the external electrodes 4*a*, 4*b* by soldering or the like thus obtaining the winding-type coil component 10 having the structure shown in FIG. 1(*a*) and FIG. 1(*b*).

As described above, according to the method of manufacturing a winding-type coil component of Embodiment 1, it is possible to form the core member provided with the external electrodes which are inclined such that heights of the external electrodes are gradually increased from the inner wall surface sides to the outer wall surface sides of the first-side flange portion and the second-side flange portion (inclined external electrode) with certainty.

As a result, it is possible to manufacture a highly reliable winding-type coil component provided with the inclined external electrodes having high shape accuracy with certainty.

Further, according to the method of manufacturing a winding-type coil component of Embodiment 1, the inclination of the external electrode can be changed and hence, the method can satisfy a demand for the manufacture of plural kinds of winding-type coil components provided with external electrodes having different inclination angles respectively.

Embodiment 2

Figure 9:
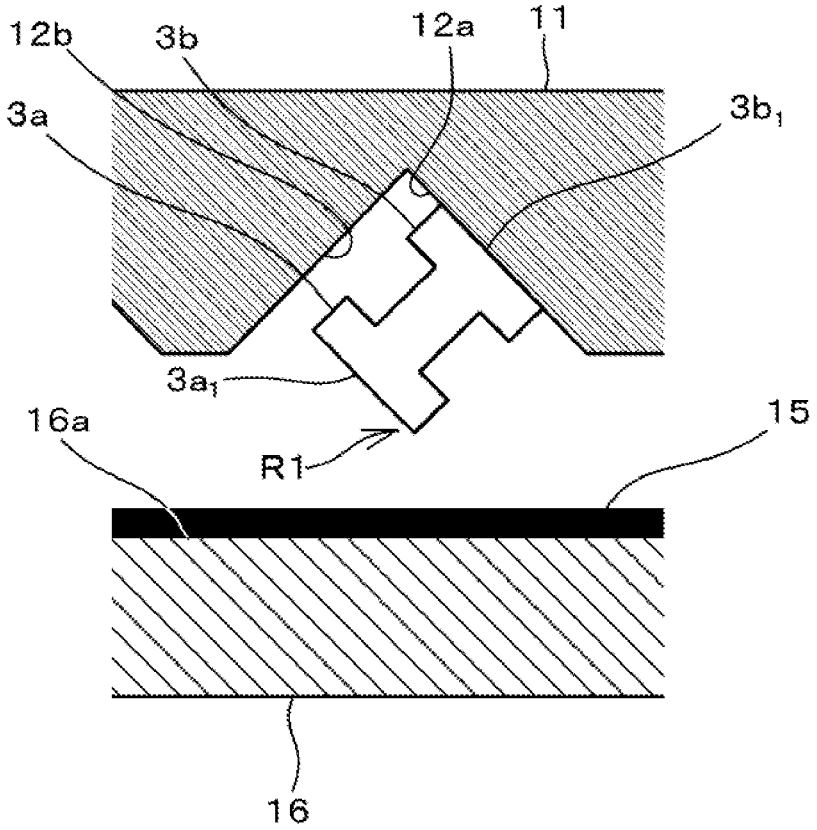
FIG. 9 is a view for describing a method of manufacturing a winding-type coil component according to Embodiment 2 of the present disclosure, and is also a view showing a state where a core member is held on a holding member.
Figure 10:
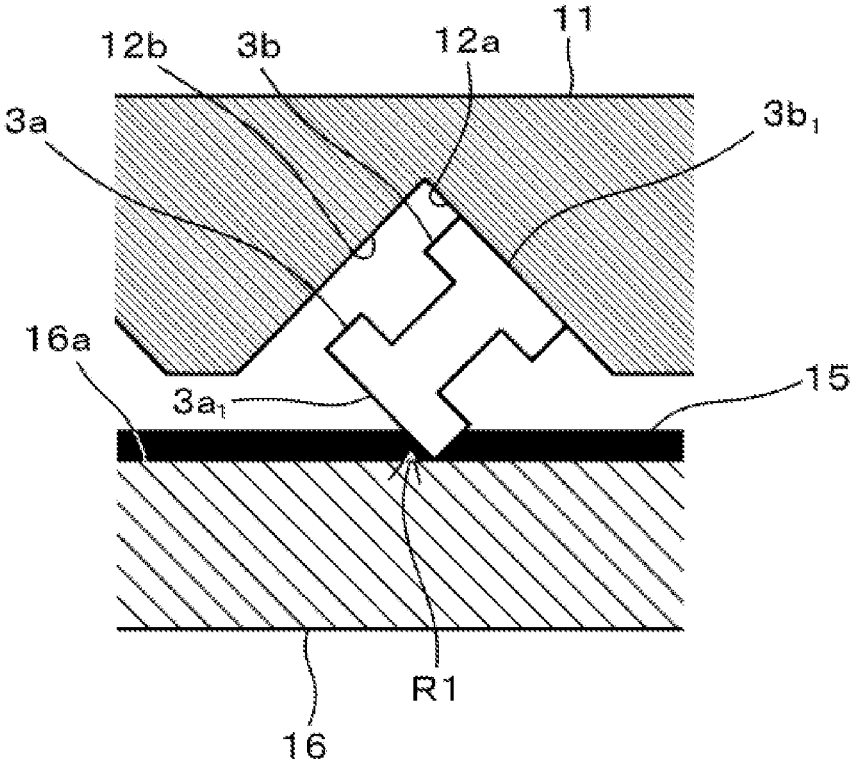
FIG. 10 is a view showing "a first stage of a coating step" where an electrode paste is applied by coating to a region of the core member where an external electrode provided on a first-side flange portion of the core member is to be formed in the method of manufacturing a winding-type coil component according to Embodiment 2 of the present disclosure.

FIG. 9 is a view showing a state where a core member 1 is held on a holding member 11 in another embodiment (Embodiment 2) of the present disclosure. FIG. 10 is a view showing a state where a region R1 of the core member 1 held on the holding member 11 where an external electrode 4*a* formed on a first-side flange portion 3*a* (FIG. 1(*a*)) is to be formed is brought into contact with a surface plate 16 where an electrode paste layer is formed on a surface 16*a* of the surface plate 16 by applying an electrode paste 15 to the surface 16*a*.

In Embodiment 2, as shown in FIG. 9, the core member 1 is held on the holding member 11 such that an outer wall surface $3b_1$ of a second-side flange portion 3*b* of the core member 1 is adhered to and held on a first-side inclined surface 12*a* of the holding member 11, and the core member 1 assumes a posture that an axis 2*a* of a winding core portion 2 of the core member 1 has an inclination of a predetermined angle with respect to a main surface 11*a* of the holding member 11 and the region R1 of the core member 1 where an external electrode 4*a* formed on the first-side flange portion 3*a* of the core member 1 (FIG. 1(*a*)) is to be formed protrudes more from the main surface 11*a* of the holding member 11 than a second-side flange portion 3*b*.

Next, as shown in FIG. 10, the region R1 of the core member 1 held on the holding member 11 where the external electrode 4*a* formed on the first-side flange portion 3*a* (FIG. 1(*a*)) is to be formed is brought into contact with the surface plate 16 where the electrode paste layer is formed by applying the electrode paste 15 to the surface 16*a*. At this stage of operation, as shown in FIG. 10, the region R1 is brought into contact with the surface plate 16 to an extent that the holding member 11 is not deformed (a first stage of a coating step).

Figure 11:
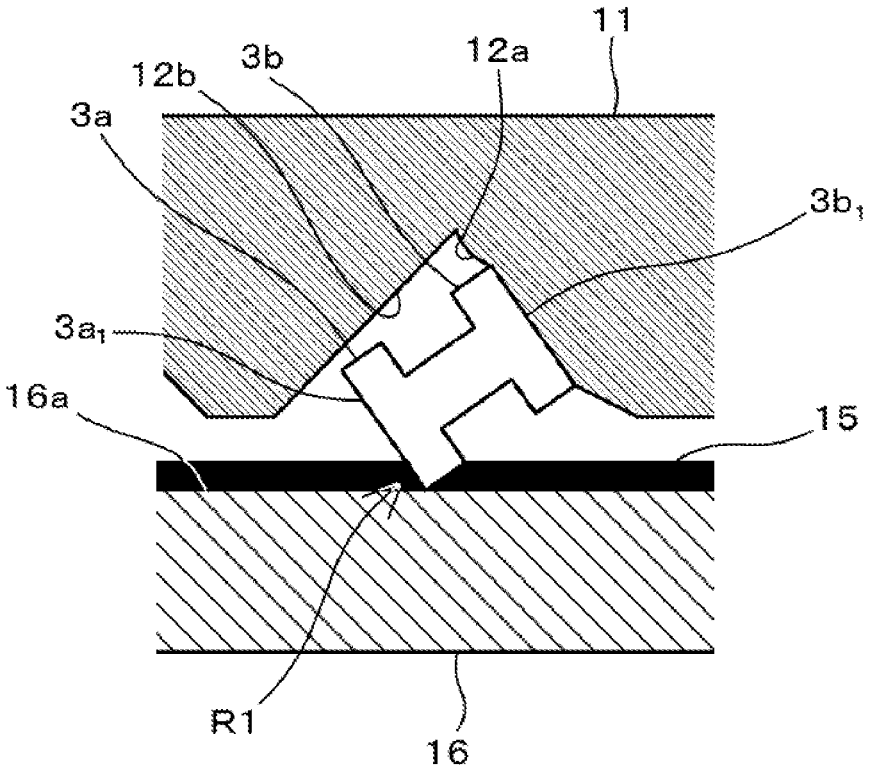
FIG. 11 is a view showing "a second stage of the coating step" where the electrode paste is applied by coating to the region of the core member where the external electrode provided on the first-side flange portion of the core member is to be formed in the method of manufacturing a winding-type coil component according to Embodiment 2 of the present disclosure.
Figure 12:
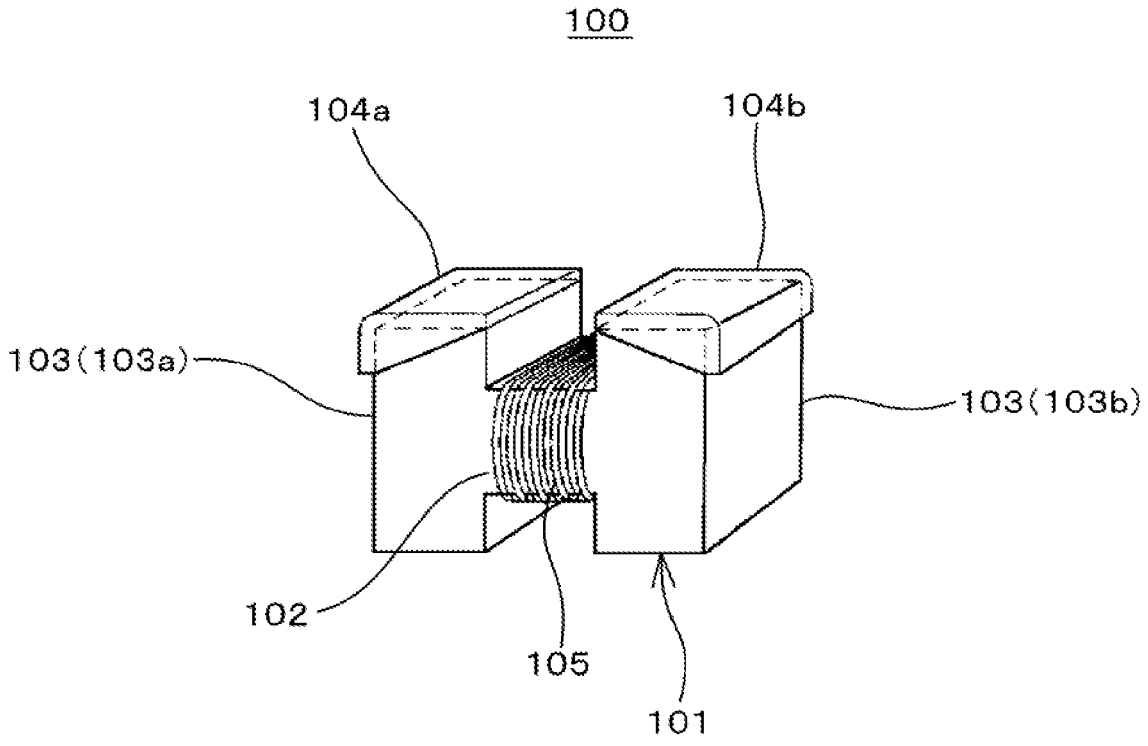
FIG. 12 is a view showing a winding-type coil component manufactured by a conventional method of manufacturing a winding-type coil component.
Figure 13:
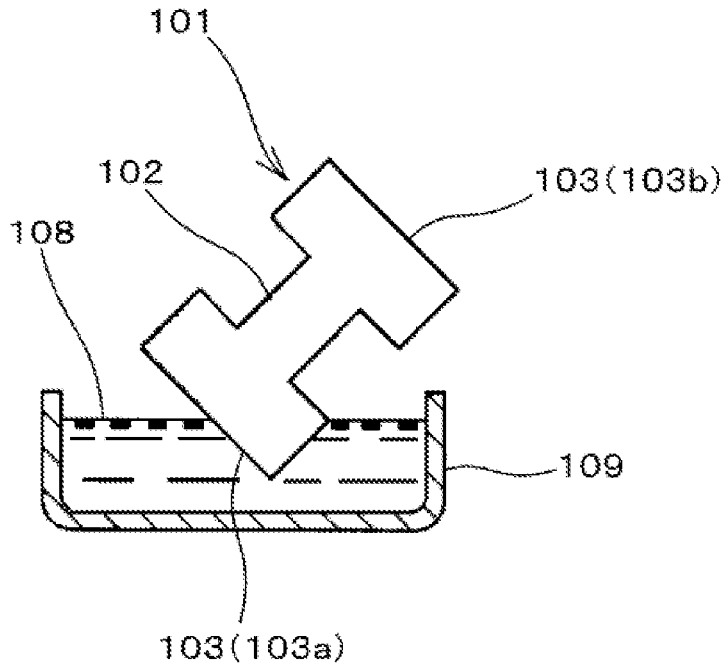
FIG. 13 is a view showing the method of manufacturing a winding-type coil component in FIG. 12.

Then, as shown in FIG. 11, the holding member 11 is further pressed toward the surface plate 16 so that a posture of the core member 1 is changed thus changing the inclination of an axis 2*a* of a winding core portion 2 of the core member 11 with respect to the surface 16*a* of the surface plate 16 (a second stage of the coating step).

At this stage of operation, the holding member 11 having elasticity is deformed so that a change in posture of the core member 1 is allowed.

As a result, through the above-mentioned first stage of the coating step and second stage of the coating step, it is possible to form a pattern (electrode paste coating pattern) where the pattern ranging from a first surface side (inner wall surface side) of the first-side flange portion 3*a* which opposedly faces the second-side flange portion 3*b* (FIG. 1(*a*)) to a second surface side (outer wall surface side) of the first-side flange portion 3*a* opposite to the first surface side, at the same time, the pattern is inclined such that a height of the pattern is gradually increased from the inner wall surface side to the outer wall surface side.

Thereafter, although not particularly shown in the drawing, the core members 1 are transferred to a transfer sheet using a method substantially equal to the method described in Embodiment 1 and, thereafter, the core members 1 are held such that an outer wall surface $\mathbf{3}a_1$ of the first-side flange portion 3*a* of the core member 1 is adhered to and held on a second-side inclined surface 12*b* of the holding member 11, and the core member 1 assumes a posture that a region R2 of the core member 1 where an external electrode 4*b* formed on the second-side flange portion 3*b* of the core member 1 (FIG. 1(*a*)) is to be formed protrudes more from the main surface 11*a* of the holding member 11 than the first-side flange portion 3*a*.

Then, through the above-mentioned first stage of the coating step and first stage of the coating step, a pattern (electrode paste coating pattern) which is inclined such that a height of the pattern is gradually increased from the inner wall surface side to the outer wall surface side is also formed on the second-side flange portion 3*b*.

Thereafter, through a step of baking the electrode paste coating pattern, a step of winding a winding on the winding core portion, and a step of connecting both ends of the winding to the external electrodes using a method substantially equal to the method described in Embodiment 1, a winding-type coil component such as shown in FIG. 1(*a*) and FIG. 1(*b*) can be acquired.

Also in the method of manufacturing a winding-type coil component of Embodiment 2, in the same manner as the above-mentioned Embodiment 1, it is possible to manufacture a highly reliable winding-type coil component provided with the inclined external electrodes having high shape accuracy with certainty.

Also in the method of manufacturing a winding-type coil component of Embodiment 2, inclination of the external electrode can be changed so that the method can satisfy a demand for the manufacture of plural kinds of winding-type coil components provided with external electrodes having different inclination angles respectively.

In the above-mentioned Embodiments 1 and 2, the description has been made by taking the case where the first-side inclined surface and the second-side inclined surface are formed of a pair of inclined surfaces which forms a V-shaped groove as an example. However, it may be also possible to adopt the configuration where the first-side inclined surface and the second-side inclined surface are formed of a pair of inclined surfaces which forms a groove having an inverted trapezoidal shape, for example.

It may be also possible to adopt the configuration where the first-side inclined surface and the second-side inclined surface are not formed of inclined surfaces which form portions of a groove.

In the above-mentioned embodiments, as the transfer sheet, the sheet whose adhesiveness is lost by irradiating ultraviolet rays to the sheet (UV sheet) is used. However, it may be also possible to use a sheet whose adhesiveness is lost by heating the sheet (heat peel off sheet) as the transfer sheet.

The present disclosure is not limited to the above-mentioned embodiments in other configurations. Various variations and modifications can be made with respect to the specific configuration of the core member and the specific configuration of the holding member within the scope of the present disclosure.

What is claimed is:

1. A coil component comprising:

a core including a winding core portion;

a first flange portion provided at one end of the winding core portion and including a first inner surface, a first outer surface, and a first main surface extending between the first inner surface and the first outer surface;

a second flange portion provided at another end of the winding core portion and including a second inner surface, a second outer surface, and a second main surface extending between the second inner surface and the second outer surface;

a first external electrode disposed on the first flange portion;

a second external electrode disposed on the second flange portion; and a winding wound on the winding core portion; wherein the first external electrode includes a first upper side located on and extending across the first main surface of the first flange portion;

the second external electrode includes a second upper side located on and extending across the second main surface of the second flange portion; and an inclination of the first upper side is different from an inclination of the second upper side.

* * * * *